United States Patent [19]

Frank

[11] Patent Number: 4,657,491

[45] Date of Patent: Apr. 14, 1987

[54] BLADE SEALING FOR IMPELLER PUMPS

[75] Inventor: Rüdiger Frank, Brühl, Fed. Rep. of Germany

[73] Assignee: Robert Bosch GmbH, Stuttgart, Fed. Rep. of Germany

[21] Appl. No.: 776,955

[22] Filed: Sep. 17, 1985

[30] Foreign Application Priority Data

Nov. 24, 1984 [DE] Fed. Rep. of Germany ... 8434465[U]

[51] Int. Cl.[4] ..... F04O 27/00

[52] U.S. Cl. ..... 418/136; 418/137

[58] Field of Search ..... 418/136–138, 418/152, 153, 235

[56] References Cited

U.S. PATENT DOCUMENTS 3,437,265 4/1969 Rohde ..... 418/137

3,456,624 7/1969 Okamoto ..... 418/178

3,790,317 2/1974 Hyde ..... 418/137

4,451,218 5/1984 Rembold ..... 418/137

*Primary Examiner*—Carlton R. Croyle

*Assistant Examiner*—Jane E. Obee

*Attorney, Agent, or Firm*—Michael J. Striker

[57] ABSTRACT

A sealing for a rotary impeller blade partially extending outwardly from a rotor of an impeller pump includes two sealing strips of plastics, the ends of which abut against the opposing side faces of the blade in the region of a slot found in the rotor, and two respective supporting members of metal. Each supporting member secured to the assigned sealing strips reliably supports the sealing strip whereby the sealing strips resist to vibrations occurring at high speeds of the pump during operation.

7 Claims, 1 Drawing Figure

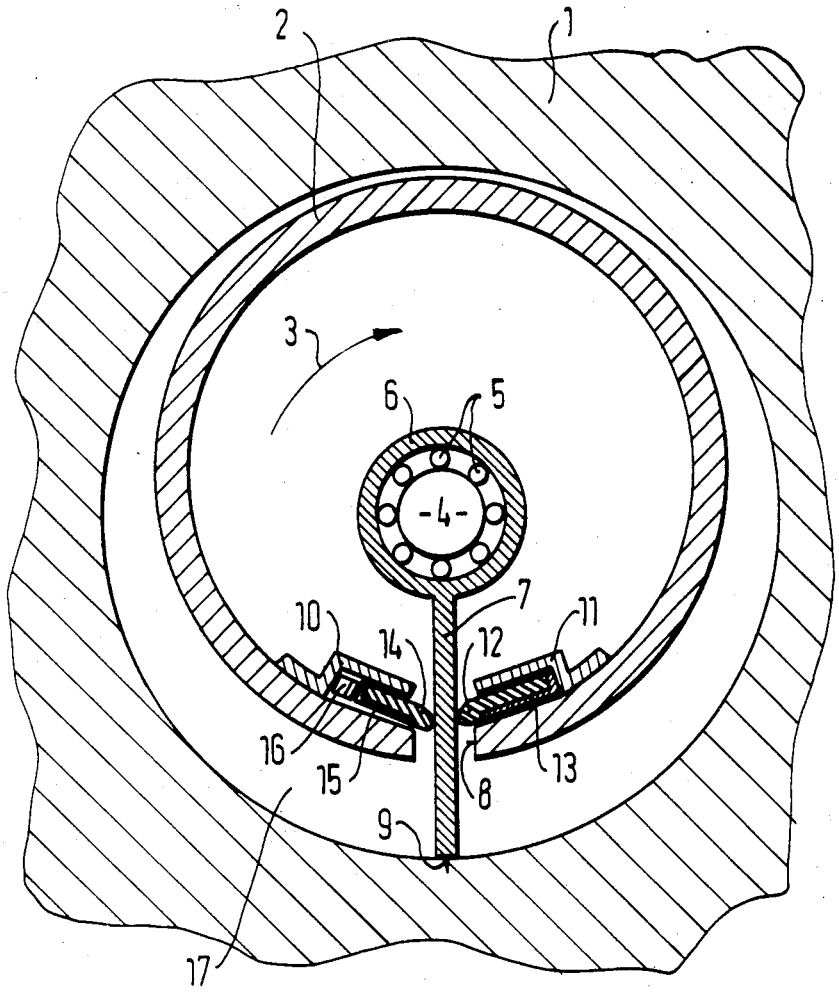
2
1
3
6
5
-4-
7
10
11
14
12
16
15
13
8
9
17

BLADE SEALING FOR IMPELLER PUMPS

BACKGROUND OF THE INVENTION

The present invention relates to an impeller pump in general, and more particularily to a sealing of a blade of the impeller pump.

Blade sealings of the type under consideration have been known. One of such sealings has been disclosed, for example in DE-OS No. 2,354,277. Sealing strips of non-metallic material, for example carbon or graphite-containing plastics, have been utilized to seal the blade of the impeller pump. Such strips have good sealing and sliding properties, when the impeller blades, which are sealed by those strips, are made not only of metal but also when the blades of the impeller are formed of suitable plastics. In operation of the impeller pumps with ligh speeds vibrations occur. However, the conventional strips can not withstand loads exerted on the impeller by such vibrations for a long time. These strips break relatively soon.

SUMMARY OF THE INVENTION

It is an object of the present invention to provide an improved sealing for an impeller blade.

It is another object of the invention to provide a blade sealing in which rupture of the sealing strips would be totally avoided.

These and other objects of the invention are attained by a sealing of an impeller blade of an impeller pump having a housing, a rotor eccentrically positioned in said housing, and at least one rotary blade partially extended outwardly of said rotor through a slot formed in said rotor, the sealing comprising sealing strips positioned at said slot and abutting against opposing side faces of said blade, respectively; and supporting elements each supporting an assigned sealing strip and being of high rigidity in a longitudinal and transverse direction thereof so that it can resist to vibrations during the operation at high speeds. Thereby the service life of the sealing strips is substantially increased.

Each supporting element may be of L-shaped cross-section.

Each supporting element may be made of metallic material.

Each sealing strip may be formed of non-metallic material, such as carbon-containing or graphite-containing plastics.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single figure of the drawing illustrates a sectional view through the impeller pump of the present invention.

DETAILED DESCRIPTION OF THE PREFERRED EMBODIMENT

Referring now to the drawing in detail, the impeller pump housing is denoted by a reference numeral 1. A rotor 2 is eccentrically positioned in housing 1. This rotor is connected to a non-illustrated drive which rotates the rotor in the direction of arrow 3. Concentrically of the housing 1, is positioned a shaft 4 which is supported by means of needles 5 in a sleeve 6 of an impeller blade 7. The impeller blade 7 extends outwardly of the rotor 2 through a slot 8 provided in the rotor and abuts with its end surface 9 against a peripheral surface of a cylindrical recess formed in the housing 1. Pockets 10 and 11 are secured to the inner surface of the rotor 2 at two sides of slot 8. Pocket 11 receives a sealing strip 12 which is connected to an L-shaped support 13. The inclined and rounded edge of the sealing strip 12 projecting outwardly from the pocket 11 lies against the side surface of the impeller blade 7. A sealing strip 14 rigidly mounted on a support 15 is disposed together with that support in the opposite pocket 10. Pocket 10 further receives a spring 16 which is positioned behind the support 15. Spring 16 urges the support 15 and the sealing strip 14 therewith towards the impeller blade 7. As clearly seen from the drawing, the end portion of the sealing strip 14, facing the blade, is formed similarly to that of the opposing sealing strip 12. The end portions of the sealing sprips 14 and 12 sealingly abut against the opposite side faces of the blade. The interior of the rotor 2 is thereby sealed relative to a working chamber 17 formed by the housing 1.

The sealing strip-support connection disclosed herein withstands also high vibration loads occuring at high speeds of the rotor 2.

It will be understood that each of the elements described above, or two or more together, may also find a useful application in other types of impeller sealing differing from the types described above.

While the invention has been illustrated and described as embodied in an impeller sealing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sealing of an impeller blade of an impeller pump having a housing, a rotor eccentrically positioned in said housing, and a least one rotary blade partially extended outwardly of said rotor through a slot formed in said rotor, the sealing comprising sealing strips positioned at said slot and abutting against opposing side faces of said blade, respectively; and supporting elements each being rigidly connected to and supporting an assigned sealing strip and being of high rigidity in a longitudinal and transverse direction thereof.

2. The sealing as defined in claim 1, wherein each supporting element is of L-shaped cross-section.

3. The sealing as defined in claim 1, wherein each supporting element is made of metallic material.

4. The sealing as defined in claim 1, wherein each sealing strip is formed of non-metallic material.

5. The sealing as defined in claim 4, wherein each sealing strip is formed of carbon-containing plastics.

6. The sealing as defined in claim 4, wherein each sealing strip is formed of graphite-containing plastics.

7. A sealing of an impeller blade of an impeller pump having a housing, a rotor eccentrically positioned in said housing, and a least one rotary blade partially extended outwardly of said rotor through a slot formed in said rotor, the sealing comprising sealing strips positioned at said slot and abutting against opposing side faces of said blade, respectively; supporting elements each rigidly connected to and supporting an assigned sealing strip and being of high rigidity in a longitudinal and transverse direction thereof; and pocket-like elements mounted to an inner surface of said rotor and forming pockets, each supporting element with the sealing strip assigned thereto being inserted in a pocket of the respective pocket-like element.

* * * * *